US011939987B2

(12) United States Patent
Fulcher

(10) Patent No.: US 11,939,987 B2
(45) Date of Patent: Mar. 26, 2024

(54) BLADE SOX

(71) Applicant: Eric Fulcher, Houston, TX (US)

(72) Inventor: Eric Fulcher, Houston, TX (US)

( * ) Notice: Subject to any disclaimer, the term of this patent is extended or adjusted under 35 U.S.C. 154(b) by 418 days.

(21) Appl. No.: 16/377,160

(22) Filed: Apr. 6, 2019

(65) Prior Publication Data

US 2020/0318643 A1 Oct. 8, 2020
US 2022/0042516 A9 Feb. 10, 2022

Related U.S. Application Data

(60) Provisional application No. 62/654,247, filed on Apr. 6, 2018.

(51) Int. Cl.
*F04D 25/08* (2006.01)
*F04D 29/00* (2006.01)
*F04D 29/38* (2006.01)

(52) U.S. Cl.
CPC ..... *F04D 25/088* (2013.01); *F04D 29/002* (2013.01); *F04D 29/388* (2013.01)

(58) Field of Classification Search
CPC ..... F04D 29/70; F04D 29/701; F04D 29/703
USPC ..... 416/62
See application file for complete search history.

(56) References Cited

U.S. PATENT DOCUMENTS

| | | | | |
|---|---|---|---|---|
| 5,947,686 | A * | 9/1999 | Keyes | F04D 29/388 239/35 |
| 9,599,116 | B1 * | 3/2017 | Winger | F04D 29/325 |
| 2004/0141848 | A1 * | 7/2004 | Beaven | F04D 25/088 416/247 R |
| 2012/0224967 | A1 * | 9/2012 | Radabaugh | F04D 29/705 416/62 |
| 2017/0030379 | A1 * | 2/2017 | Garcia | F04D 29/703 |
| 2018/0017085 | A1 * | 1/2018 | Rivera | F04D 29/703 |
| 2018/0135656 | A1 * | 5/2018 | Totten | A47L 25/00 |

* cited by examiner

*Primary Examiner* — William V Gilbert
(74) *Attorney, Agent, or Firm* — Kearney, McWilliams & Davis; Erik J. Osterrieder

(57) ABSTRACT

A system for converting a ceiling fan having blades into an air cleaning and air freshening device which fit snugly over the blades of a ceiling fan, their shape conforming to that of the blade structured and arranged to disperse a fresh and pleasing scent into a room with the fan in motion, and attract and capture dust and other allergens, while facilitating the cleaning of the fan blades when removed.

20 Claims, 3 Drawing Sheets

BLADE SOX

CROSS-REFERENCE TO RELATED APPLICATION

The present application is related to and claims priority from prior provisional application Ser. No. 62/654,247, filed Apr. 6, 2018 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of covering devices and more specifically relates to a system for converting a ceiling fan having blades into an air cleaning and air freshening device which fit snugly over the blades of a ceiling fan, their shape conforming to that of the blade structured and arranged to disperse a fresh and pleasing scent into a room with the fan in motion, and attract and capture dust and other allergens, while facilitating the cleaning of the fan blades when removed.

2. Description of the Related Art

A fan suspended from the ceiling of a room is a ceiling fan. Modern ceiling fans have a lineage that extends back to the 16th century "punkah" fans of the Middle East, which were operated manually by servants known as punkah wallahs. The Industrial Revolution in the early 1800s introduced large belt-driven fans powered by factory waterwheels. Further developments followed, and by 1882 an inventor named Philip H. Diehl had introduced the electric rotary ceiling fan. In Diehl's time, electric fans were used only in commercial establishments or in well-to-do households.

In our own day, ceiling fans are utilitarian and commonplace. They may be used in homes that lack central air-conditioning, or in conjunction with air-conditioning to reduce energy bills. Ceiling fans can be used as a cooling device in warm months, pushing air down to create a wind-chill effect, and as a heat transferer (pulling warm air up) in colder months. But while they undoubtedly promote increased circulation of air throughout the indoor spaces of the home, ceiling fans have the disadvantage of moving not only the air—but also the particulate matter, dust and allergens, that the air picks up and carries. Indoor air always has a great deal of dust in it larger particles that are visible, and also microscopic ones. Over time, a large volume of the circulating air hits the blades of the fan, and dust collects on the blades. This dust is not only unsightly and a pain to clean—it also indicates that the fan is moving dust and allergens throughout the air we breathe.

Various attempts have been made to solve problems found in covering device art. Among these are found in: U.S. Pub. No. 2012/0224967 to Taylor Radabaugh; U.S. Pat. No. 5,947,686 to Tina M. Keyes; and U.S. Pub. No. 2004/0247440 to Anthony Boubin. This prior art is representative of covering devices for ceiling fans comprising at least one scent.

Ideally, a system for converting a ceiling fan having blades into an air cleaning and air freshening device should be user-friendly and safe in-use and yet would operate reliably and be manufactured at a modest expense. Thus, a need exists for a system for converting a ceiling fan having blades into an air cleaning and air freshening device which fit snugly over the blades of a ceiling fan, their shape conforming to that of the blade structured and arranged to disperse a fresh and pleasing scent into a room with the fan in motion, and attract and capture dust and other allergens, while facilitating the cleaning of the fan blades when removed and to avoid the above-mentioned problems.

BRIEF SUMMARY OF THE INVENTION

In view of the foregoing disadvantages inherent in the known covering devices art, the present invention provides a novel System for Converting a Ceiling Fan Having Blades into an Air Cleaning and Air Freshening Device (Entitled Blade Sox). The general purpose of the present invention, which will be described subsequently in greater detail is to provide a covering devices and more specifically relates to a system for converting a ceiling fan having blades into an air cleaning and air freshening device which fit snugly over the blades of a ceiling fan, their shape conforming to that of the blade structured and arranged to disperse a fresh and pleasing scent into a room with the fan in motion, and attract and capture.

A set of devices for covering blades of a ceiling fan, the set of devices comprising: a device for each of the blades of the ceiling fan and each device is configured as a tube-shaped casing with an open end for sliding the casing over at least part of a blade of the ceiling fan so as to envelope the casing over at least the part of the blade. The casing capable of holding at least part of particulate matter that lands on the stretchable material from air around the ceiling fan. The casing being scented for freshening the air.

A device for covering a blade of a ceiling fan for air cleaning and air-freshening while the device is mounted on the blade, the device comprising: a sleeve having an open end for mounting the sleeve on a blade of a ceiling fan. The sleeve being substantially as long as the blade of the ceiling fan. The sleeve being of stretchable material for conforming the sleeve in shape to the blade of the ceiling fan. The stretchable material of the sleeve being capable of holding at least part of particulate matter that lands on the stretchable material from air around the ceiling fan. The stretchable material being scented for freshening the air.

A system for converting a ceiling fan having blades into an air cleaning and air freshening device, the system comprising: a set of sheaths for substantially covering the blades of the ceiling fan with each sheath in the set of sheaths respectively substantially covering a blade of the blades of the ceiling fan. Each sheath is interchangeable with another sheath of the set of sheaths. Each sheath is shaped generally as a tube with an elastic open end that stretches for mounting the sheath on the blade and that shrinks for conforming in shape to the blade after mounting. Each sheath is made of stretchable material capable of conforming in shape to the blade. The stretchable material of each sheath is capable of attracting and capturing particulate matter from air. The stretchable material is scented for freshening the air.

The present invention holds significant improvements and serves as a System for Converting a Ceiling Fan Having Blades into an Air Cleaning and Air Freshening Device. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a System for Converting a Ceiling Fan Having Blades into an Air Cleaning and Air Freshening Device (Entitled Blade Sox), constructed and operative according to the teachings of the present invention.

The various embodiments of the present invention will hereinafter be described in conjunction with the appended drawings, wherein like designations denote like elements.

DETAILED DESCRIPTION

Figure 1:
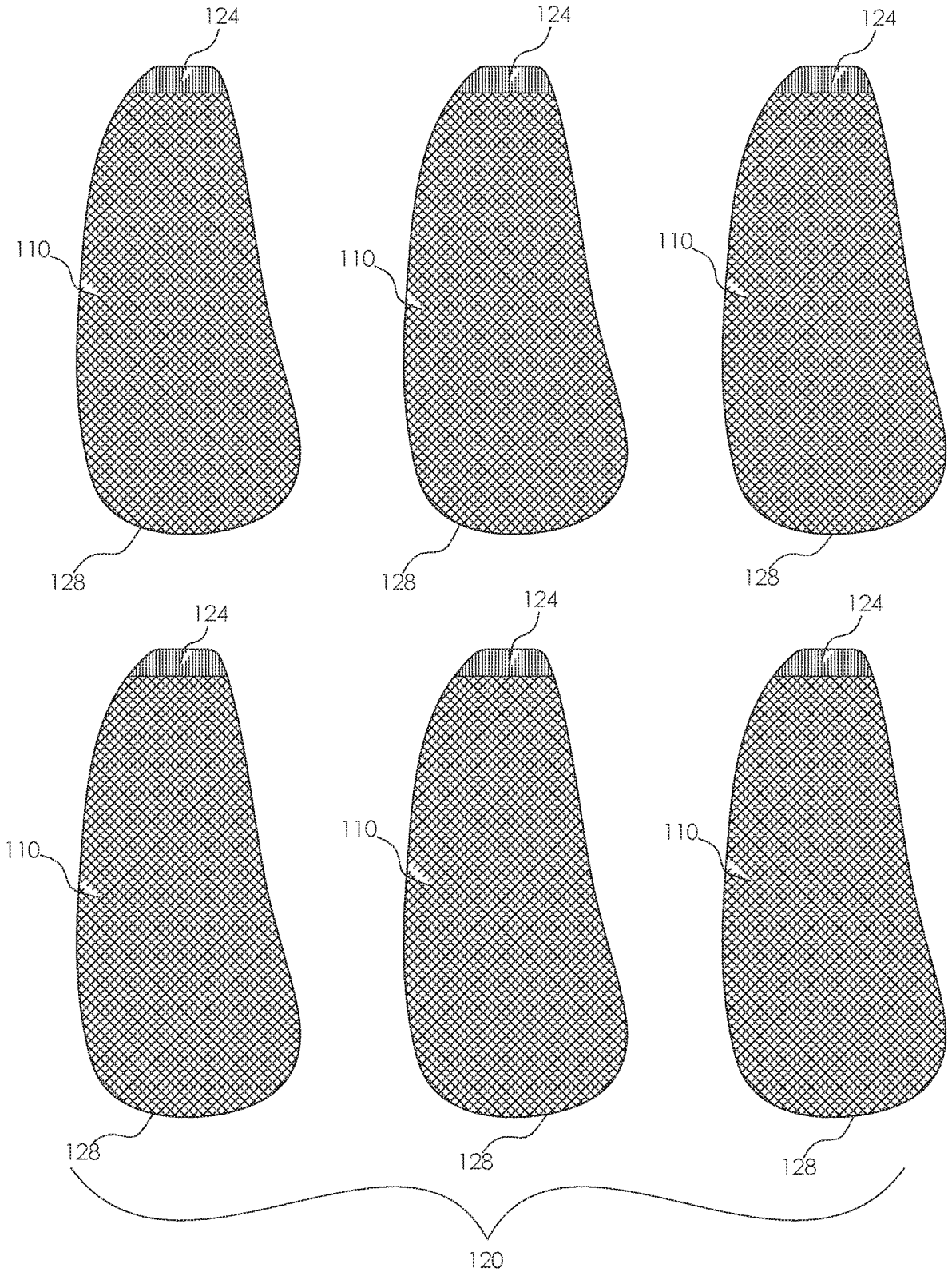
FIG. 1 shows a perspective view illustrating a set of sheaths of a System for Converting a Ceiling Fan Having Blades into an Air Cleaning and Air Freshening Device according to an embodiment of the present invention.

As discussed above, embodiments of the present invention relate to a covering devices and more particularly to a System for Converting a Ceiling Fan Having Blades into an Air Cleaning and Air Freshening Device (Entitled Blade Sox) which fit snugly over the blades of a ceiling fan, their shape conforming to that of the blade structured and arranged to disperse a fresh and pleasing scent into a room with the fan in motion, and attract and capture.

Generally speaking, the Blade Sox comprises a specially designed simple product which will convert any ceiling fan into an air-cleaning and air-freshening device.

Various sizes could be produced to accommodate the various-sized blades of ceiling fans, however, these expandable sheathes would also conform to the size and shape of most standard fan blades. Removable and disposable, the Fan Sox would be scented with a variety of fresh, pleasing scents: Mountain Meadow, Forest Rain, Surf and Spray, or Alpine Spring, for example. The Fan Sox would be elasticized to ensure a snug fit on the blades and could be offered in a variety of fabric colors and prints to suit the range of consumer decors. As mentioned, the Fan Sox could be produced with seasonal and holiday themed designs and prints—and the scents might be similarly themed: balsam at Christmas time, perhaps pumpkin or sage at Thanksgiving. In addition to being impregnated with the scent they will disperse, the fabrics might also be treated electrostatically to enhance their attraction and capture of dust.

To equip a ceiling fan, one would simply slide the Fan Sox snugly over the blades. The outer surface of the Fan Sox will trap dust particles from the air which come into contact with the blades, and then hold that dust like a dust magnet. The Fan Sox will do this by a combination of the ceiling fan's inherent electrostatic, dust-attracting properties, and the dust-catching surface of the fabric. When they have reached the end of their useful life, the Fan Sox would simply be removed and disposed of, and a new set put on. The Fan Sox would benefit anyone concerned about improving the air-quality within their home, business, or office.

At the same time that the Fan Sox are removing dust and allergens from the air, they are also freshening the air with a pleasing scent. And beyond the air cleaning/air-freshening properties, there is also this: as anyone who has cleaned the blades of a ceiling fan knows, it can be a nasty, dusty job. But with use of the Fan Sox, there's no need to clean the blades at all—you just dispose of the Fan Sox when they've reached their capacity and put on a new set. Simple, affordable, and easy to use, the Fan Sox system should find a wide and enthusiastic reception in the markets of America and the world.

A set of devices for covering blades of a ceiling fan, the set of devices comprising: a device for each of the blades of the ceiling fan and each device is configured as a tube-shaped casing with an open end for sliding the casing over at least part of a blade of the ceiling fan so as to envelope the casing over at least the part of the blade. The casing capable of holding at least part of particulate matter that lands on the stretchable material from air around the ceiling fan. The casing being scented for freshening the air. Wherein the casing of each device comprises stretchable material for conforming the casing in shape to at least the part of the blade of the ceiling fan enveloped by the casing. Wherein the casing comprises at least in part material for attracting the particulate matter from the air around the ceiling fan. Wherein each of the devices is interchangeable with another of the set of devices. Wherein the open end of the casing comprises an elastic open end that stretches for sliding the casing over at least part of the blade and that shrinks for conforming the open end of the casing in shape to the blade. Wherein the casing scented for freshening the air comprises stretchable material dispersing scent into the air. Wherein each of the devices is selectively removable from its blade of the ceiling fan. Wherein the casing comprises a closed end opposite to the open end.

A device for covering a blade of a ceiling fan for air cleaning and air-freshening while the device is mounted on the blade, the device comprising: a sleeve having an open end for mounting the sleeve on a blade of a ceiling fan. The sleeve being substantially as long as the blade of the ceiling fan. The sleeve being of stretchable material for conforming the sleeve in shape to the blade of the ceiling fan. The stretchable material of the sleeve being capable of holding at least part of particulate matter that lands on the stretchable material from air around the ceiling fan. The stretchable material being scented for freshening the air. Wherein the stretchable material comprises electrostatic stretchable material to attract the particulate matter. Wherein the sleeve is washable. Wherein the open end of the sleeve comprises an elastic open end that stretches for mounting the sleeve on the blade and that shrinks for conforming in shape to the blade after mounting, Wherein the stretchable material comprises at least in part stretchable fabric. Wherein the stretchable material being scented for freshening the air comprises stretchable material capable of dispersing scent into the air.

Figure 2:
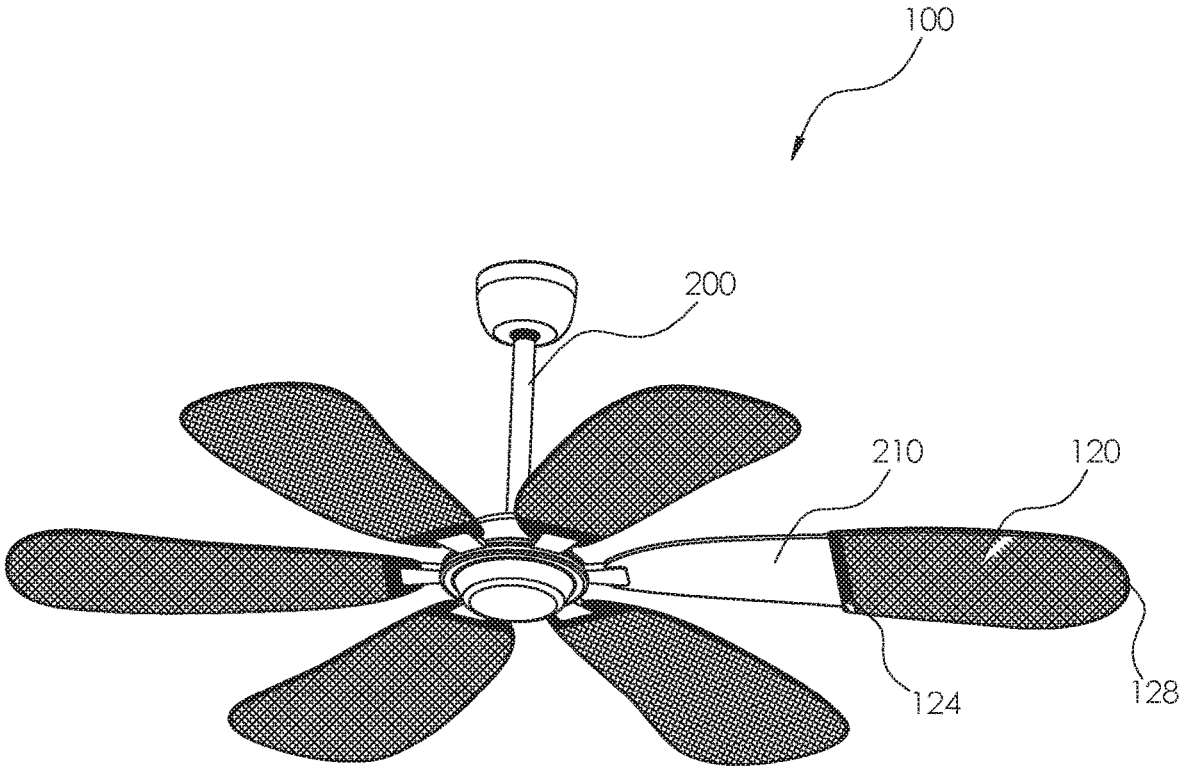
FIG. 2 is a perspective view illustrating a sheath being placed onto a ceiling fan bald on the ceiling fan of the System for Converting a Ceiling Fan Having Blades into an Air Cleaning and Air Freshening Device according to an embodiment of the present invention of FIG. 1.
Figure 3:
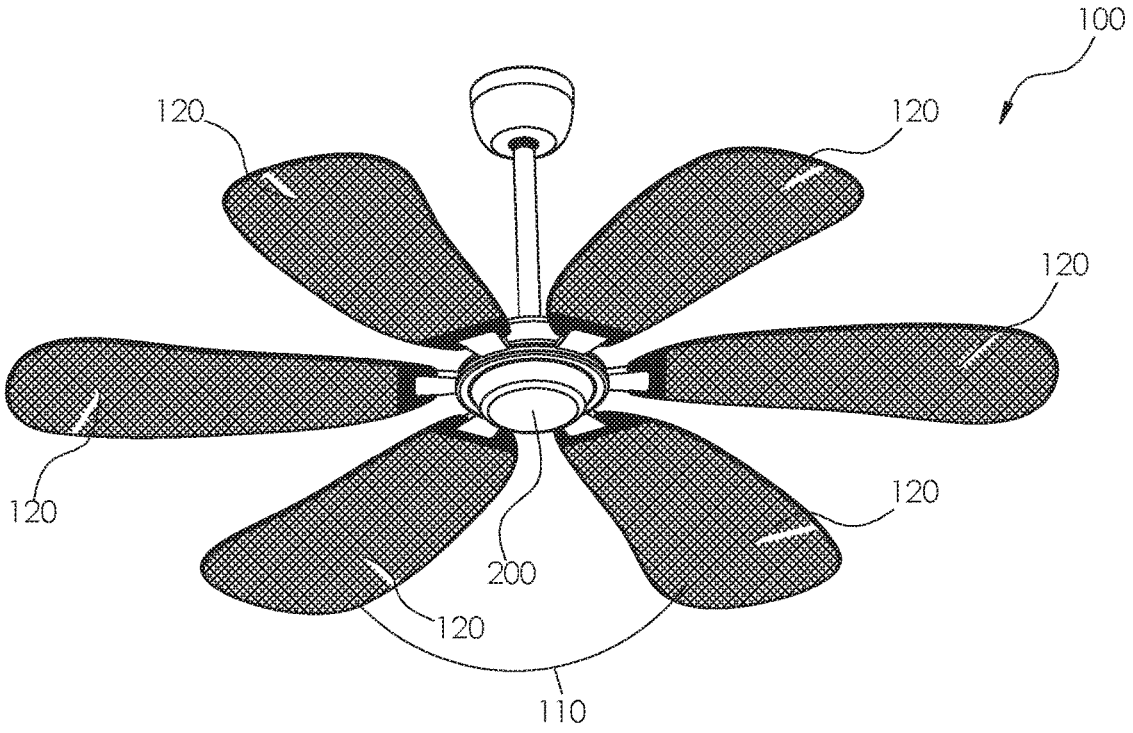
FIG. 3 is a perspective view illustrating of the set of sheaths inserted over the ceiling fan blades on the ceiling fan of the System for Converting a Ceiling Fan Having Blades into an Air Cleaning and Air Freshening Device according to an embodiment of the present invention of FIG. 1.
Figure 4:
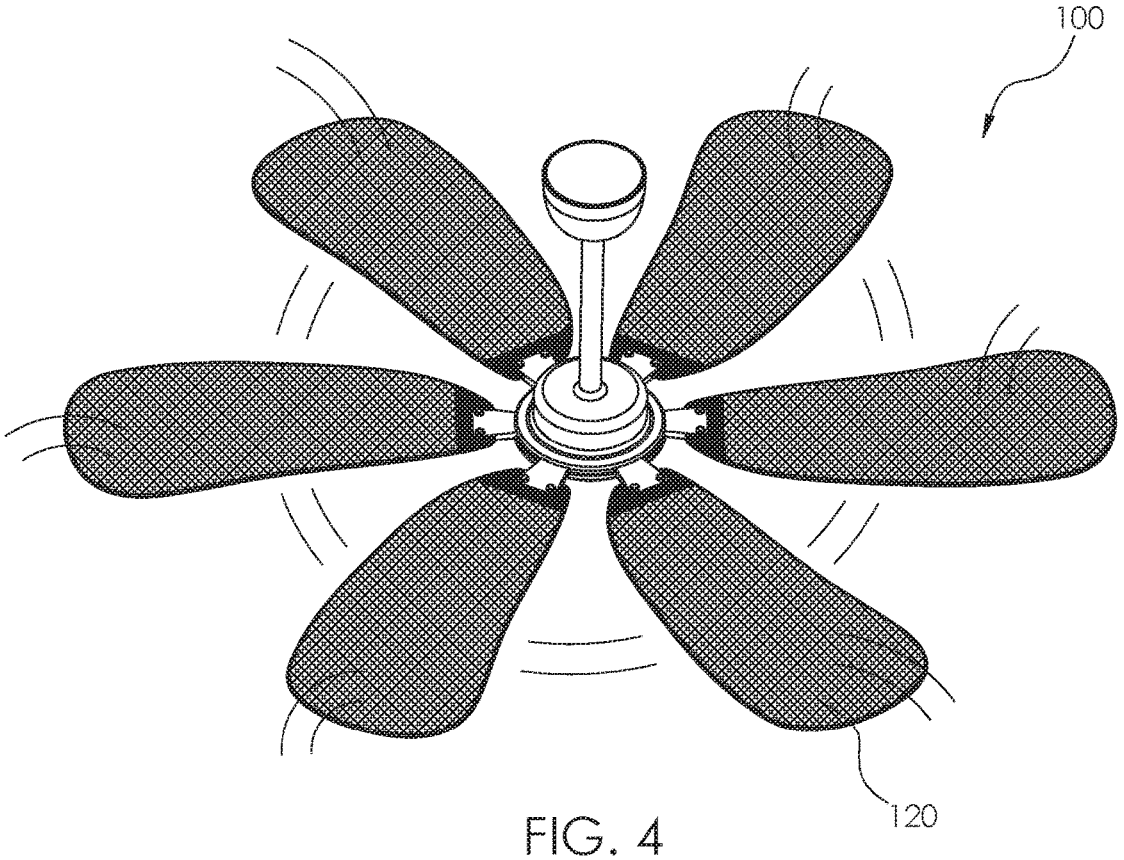
FIG. 4 is a perspective view illustrating the System for Converting a Ceiling Fan Having Blades into an Air Cleaning and Air Freshening Device in an in-use condition according to an embodiment of the present invention of FIG. 1.

Referring to the drawings by numerals of reference there is shown in FIGS. 1-4, perspective views illustrating System 100 for converting ceiling fan 200 having blades 210 into an air cleaning and air freshening device according to an embodiment of the present invention.

System 100 for converting ceiling fan 200 having blades 210 into an air cleaning and air freshening device, system 100 comprising: set of sheaths 110 for substantially covering blades 210 of ceiling fan 200 with each sheath 120 in the set of sheaths 110 respectively substantially covering a blade of the blades 210 of ceiling fan 200. Each sheath 120 is interchangeable with another sheath 120 of set of sheaths 110. Each sheath 120 is shaped generally as a tube with elastic open 124 end that stretches for mounting sheath 120 on blade 210 and that shrinks for conforming in shape to blade 210 after mounting. Each sheath 120 is made of stretchable material capable of conforming in shape to blade 210. The stretchable material of each sheath 120 is capable of attracting and capturing particulate matter from air. The stretchable material is scented for freshening the air. Wherein the stretchable material comprises electrostatic stretchable material. Wherein set of sheaths 110 is washable. Wherein each sheath 120 is shaped as the tube with the elastic open end and closed opposite end 128. Wherein the stretchable material comprises at least in part stretchable fabric. Wherein the stretchable material being scented for freshening the air comprises stretchable material capable of dispersing scent into the air.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A system for converting a ceiling fan having blades into an air cleaning and air freshening device, the system comprising:

a set of sheaths for substantially covering the blades of the ceiling fan with each said sheath in the set of sheaths substantially covering a blade of the blades of the ceiling fan, each said sheath being shaped generally as a tube with an elastic open end that stretches for mounting the sheath on the blade and that shrinks for conforming in shape to the blade after mounting, each said sheath being made of continuous stretchable material capable of conforming in shape to the blade, wherein the stretchable material is electrostatically treated, the stretchable material of each said sheath being capable of attracting and capturing particulate matter from air, and the stretchable material being scented for freshening the air.

2. The system of claim 1, wherein each said sheath being interchangeable with another said sheath of the set of sheaths.

3. The system of claim 1, wherein the set of sheaths is washable.

4. The system of claim 1, wherein each said sheath is shaped as the tube with the elastic open end and a closed opposite end.

5. The system of claim 1, wherein the stretchable material comprises at least in part stretchable fabric.

6. The system of claim 1, wherein the stretchable material being scented for freshening the air comprises the stretchable material capable of dispersing scent into the air.

7. The system of claim 1, wherein the continuous stretchable material is a band.

8. The system of claim 1, wherein the stretchable material comprises designs or prints applied to a portion of the stretchable material.

9. A device for covering a blade of a ceiling fan for air cleaning and air-freshening while the device is mounted on the blade, the device comprising:

a sleeve having an open end for mounting the sleeve on the blade of the ceiling fan, the sleeve being substantially as long as the blade of the ceiling fan, the sleeve being of continuous stretchable material for conforming the sleeve in shape to the blade of the ceiling fan, the stretchable material of the sleeve being capable of holding at least part of particulate matter that lands on the stretchable material from air around the ceiling fan, and the stretchable material being scented for freshening the air, wherein the stretchable material is electrostatically treated to attract the particulate matter.

10. The device of claim 9, wherein the sleeve is washable.

11. The device of claim 9, wherein the open end of the sleeve comprises an elastic open end that stretches for mounting the sleeve on the blade and that shrinks for conforming in shape to the blade after mounting.

12. The device of claim 9, wherein the stretchable material comprises at least in part stretchable fabric.

13. The device of claim 9, wherein the stretchable material being scented for freshening the air comprises the stretchable material capable of dispersing scent into the air.

14. A set of devices for covering blades of a ceiling fan, the set of devices comprising:

a device for each of the blades of the ceiling fan; and each said device configured as a tube-shaped casing with an open end for sliding the tube-shaped casing over at least part of a blade of the blades of the ceiling fan, the tube-shaped casing capable of attracting and holding particulate matter on a continuous stretchable material from air around the ceiling fan, wherein the stretchable material is electrostatically treated, and the tube-shaped casing being scented for freshening the air.

15. The set of devices of claim 14, wherein the tube-shaped casing of each said device comprises the stretchable material for conforming the tube-shaped casing in shape to the at least the part of the blade of the fan enveloped by the tube-shaped casing.

16. The set of devices of claim 14, wherein each of said devices is interchangeable with another said device within the set of devices.

17. The set of devices of claim 14, wherein the open end of the tube-shaped casing comprises an elastic open end that stretches for sliding the tube-shaped casing over at least part of the at least one blade and that shrinks for conforming the open end of the tube-shaped casing in shape to the blade.

18. The set of devices of claim 14, wherein the tube-shaped casing scented for freshening the air comprises the stretchable material dispersing scent into the air.

19. The set of devices of claim 14, wherein each of said devices is selectively removable from its blade of the ceiling fan.

20. The set of devices of claim 14, wherein the tube-shaped casing comprises a closed end opposite to the open end.

* * * * *